US007736135B2

(12) United States Patent
Liang et al.

(10) Patent No.: US 7,736,135 B2
(45) Date of Patent: Jun. 15, 2010

(54) STRUCTURE FOR CONTROLLING LUBRICANT'S FLOW RATE IN SCROLL COMPRESSOR

(75) Inventors: Kun-Yi Liang, Hsinchu County (TW); Shu-Er Huang, Hsinchu (TW); Chun-Chung Yang, Hsinchu (TW); Yueh-Ju Tang, Hsinchu (TW); Yu-Choung Chang, Hsinchu County (TW); Yang-Kuang Liu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/125,137

(22) Filed: May 22, 2008

(65) Prior Publication Data

US 2009/0162231 A1 Jun. 25, 2009

(30) Foreign Application Priority Data

Dec. 25, 2007 (TW) ..... 96149860 A

(51) Int. Cl.
*F03C 2/00* (2006.01)
*F03C 4/00* (2006.01)

(52) U.S. Cl. ..... 418/55.3; 418/55.5; 418/57; 418/94; 418/99; 464/102

(58) Field of Classification Search ..... 418/88, 418/94, 97–99, 55.1–55.6, 57; 464/102; 184/6.16–6.18
See application file for complete search history.

(56) References Cited

U.S. PATENT DOCUMENTS 4,564,339 A * 1/1986 Nakamura et al. ..... 418/55.6
4,623,306 A * 11/1986 Nakamura et al. ..... 418/55.6
4,696,628 A * 9/1987 Kimura et al. ..... 418/94
5,007,809 A * 4/1991 Kimura et al. ..... 418/55.1
5,211,550 A * 5/1993 Kawabe ..... 418/55.1
5,252,046 A 10/1993 Wen-Ding et al.
6,287,099 B1 * 9/2001 Chang et al. ..... 418/94
6,322,339 B1 * 11/2001 Mitsunaga et al. ..... 418/55.6
6,827,563 B2 * 12/2004 Hiwata et al. ..... 418/55.6
2005/0152802 A1 * 7/2005 Kim et al. ..... 418/55.3

FOREIGN PATENT DOCUMENTS

JP 01301972 A * 12/1989 ..... 418/55.3

* cited by examiner

*Primary Examiner*—Theresa Trieu
(74) *Attorney, Agent, or Firm*—WPAT., P.C.; Justin King

(57) ABSTRACT

A scroll compressor including a block, a fixed scroll, an orbiting scroll, a crankshaft, an Oldham ring and an oil passage is provided, wherein the fixed scroll is fixed on the block, and the orbiting scroll, the crankshaft and the Oldham ring are disposed on the block. The fixed scroll and the orbiting scroll form a gas-in area, a compressing area and a gas-out area which are connected in a series. The orbiting scroll is eccentric connected with the crankshaft to orbit over the fixed scroll and drive the Oldham ring moving. A reciprocating motion area on the block is formed via the reciprocating motion between the block and the Oldham ring, wherein the block has an oil opening in the reciprocating motion area. Besides, one terminal of the oil passage is connected to the oil opening, and another terminal of the oil passage is connected to the gas-in area and the compressing area.

15 Claims, 7 Drawing Sheets

100

100

200

200

300

STRUCTURE FOR CONTROLLING LUBRICANT'S FLOW RATE IN SCROLL COMPRESSOR

FIELD OF THE INVENTION

The present invention relates to a scroll compressor, and more particularly, to a scroll compressor capable of precisely controlling its lubricant's flow rate.

BACKGROUND OF THE INVENTION

Scroll configuration plays a very important role in the design of a scroll compressor. In a scroll compressor, a scroll fixed lap rising from a fixed plate of a fixed scroll and a scroll orbiting lap rising from an orbiting plate of an orbiting scroll are combined with each other to form compression chambers therebetween. As the moving orbiting scroll orbits around the fixed scroll, the "pockets" formed by the meshed scrolls follow the spiral toward the center and diminish in size, and thereby, the entering coolant is trapped in diametrically opposed pockets and compressed as the pockets move toward the center.

In operation, the orbiting scroll is driven to move relative to the fixed scroll in high speed that it is required to supply lubricant to the compression chambers for ensuring smooth operation of the scroll members during compression so as to reduce friction loss. Thus, it is an important issue for any scroll compressor about how to feed a proper amount of lubricant to its compression chambers. That is, if too much lubricant is supplied, system efficiency of the scroll compressor is reduced due to the happening of unwanted fluid compression phenomenon, and on the other hand, if inadequate lubricant is supplied, then the drastic friction between the fixed scroll and the orbiting scroll will cause damage to the scroll compressor.

Please refer to FIG. 1A and FIG. 1B, which are respectively a cross-sectional view of a conventional scroll compressor disclosed in U.S. Pat. No. 6,827,563 and the lubricating oil passage of the scroll compressor of FIG. 1A. The conventional scroll compressor 100 of FIG. 1A comprises a block 110, a fixed scroll 120, an orbiting scroll 130 and a crankshaft 140, in which the a fixed scroll 120, an orbiting scroll 130 and a crankshaft 140 are all disposed on the block 110.

As shown in FIG. 1A, there are compression chambers S1 formed by the meshed fixed scroll 120 and orbiting scroll 130. As the crankshaft 140 is connected to the orbiting scroll 130 in a eccentric manner to be used for bringing along the orbiting scroll 130 to orbits around the fixed scroll 120 while the fixed scroll remains fixed, the coolant trapped inside the compression chambers S1 is compressed continuously by moving it through successively smaller "pockets" formed by the orbiting scroll's rotation. In detail, when the orbiting scroll 130 is allowed to orbit around the fixed scroll 120, a circular orbit area is formed on the fixed scroll 120, and moreover, an oil opening 122 is formed in the circular orbit area while configuring an oil passage 124 in the fixed scroll 120 to be used for connecting the oil opening 122 to the compression chambers S1.

In FIG. 1A and FIG. 1B, the oil opening 122 of the orbiting scroll 130 is closed for stopping the lubricant 142 from entering the oil passage 124 while enabling the lubricant 142 to flow through the channel 144 boring through the center of the crankshaft 140 and thus fill the buffering chamber S2 enclosed between the orbiting scroll 130 and the block 110. When the orbiting scroll 130 starts to move in the circular manner relative to the fixed scroll 120, the movement of the orbiting scroll 130 will cause the oil opening 122 to open in a periodic manner for feeding the lubricant 142 to flow through the oil passage 124 and reach the compression chamber S1 so as to lubricate the fixed scroll 120 and the orbiting scroll 130.

However, as the buffering chamber S2 where the lubricant 142 settled can be categorized as a high pressure area, conventionally a regulating valve 126 is required to be installed in those conventional scroll compressor to be used for depressurize the lubricant 142 before it is fed into the compression chamber S1. Nevertheless, the addition of the regulating valve 126 not only will cause the manufacturing cost of the scroll compressor to increase, but also it will cause difficulty in both design and manufacture of the scroll compressor since the regulating valve 126 is disposed inside the fixed scroll 120.

In a conventional scroll compressor disclosed in U.S. Pat. No. 5,252,046, its oil opening is disposed on the sidewall of its block in a manner that it can be open/close by the relative movement of the orbiting scroll against the block and thus enables the lubricant to flow through the oil opening and enter the compression chamber for lubricating the fixed scroll and the orbiting scroll. However, the aforesaid arrangement will cause the oil opening to remain open for an excessively long period of time that is going to cause an uncontrollable amount of lubricant to be fed into the compression chamber and thus cause the compression efficiency of the scroll compressor to drop.

SUMMARY OF THE INVENTION

The object of the present invention is to provide a scroll compressor capable of precisely controlling the amount of lubricant to be fed into its compression chamber in a manner that not only its compression efficiency can be enhanced greatly, but also both its manufacture cost and design complexity are reduced.

Specifically, a rotation-restraint mechanism, such as an Oldham ring, is usually being configured in the block of a scroll compressor for restraining the orbiting scroll from rotating while it is allowed to orbit around the fixed scroll. Under the aforesaid arrangement, the Oldham ring is driven to move periodically in a reciprocating motion by the circularly orbiting of the orbiting scroll. By the relative movement of the Oldham ring against its block, the lubricant is fed to the compression chamber for lubrication through the oil opening of the block in a periodic manner while enabling the amount of the lubricant being fed into the compression chamber to be precisely controlled according to a result of mathematic calculation and experimental parameters.

To achieve the above object, the present invention provides a scroll compressor, comprising: a block, a fixed scroll, an orbiting scroll, a crankshaft, an Oldham ring and an oil passage, wherein the fixed scroll is fixed on the block while the orbiting scroll, the crankshaft and the Oldham ring are disposed on the block in a manner that the arrangement of the fixed scroll and the orbiting scroll forms a gas-in area, a compressing area and a gas-out area which are connected in a series; and the crankshaft is connected to the orbiting scroll in an eccentric manner for driving the orbiting scroll to orbit around the fixed scroll and thus bring the Oldham ring to move reciprocatively so that a reciprocating motion area is formed on the block via the reciprocating motion between the block and the Oldham ring. In an exemplary embodiment, the block is further configured with an oil opening at a position thereof located in the reciprocating motion area, which is connected to an terminal of the oil passage while enabling another terminal of the oil passage to be connected to the gas-in area or the compressing area.

In an exemplary embodiment of the invention, the oil passage is configured between the block and the fixed scroll, while the oil opening can be shaped as a circle or an oval being located at the center or the edge of the reciprocating motion area.

In an exemplary embodiment of the invention, the compressing area is composed of a low-pressure zone and a high-pressure zone, mutually connected with each other, in which the high-pressure area is connected to the gas-out area and the low-pressure zone is connected to the gas-in area while enabling another terminal of the oil passage to be connected to the low-pressure zone.

In an exemplary embodiment of the invention, a buffering area is formed between the orbiting scroll and the block to be used for accommodating a lubricant. In addition, the lubricant is fed into the oil passage through the oil opening in a periodic manner. Moreover, a channel is formed inside the crankshaft in a manner that an end of the channel is connected to the buffering area while enabling the other end thereof to be connected to a storage so as to enable the lubricant stored in the storage to flow into the buffering area through the channel.

In an exemplary embodiment of the invention, the scroll compressor further comprises: a motor, adapted for driving the crankshaft to rotate and thus to bring along the orbiting scroll to orbit around the fixed scroll. In addition, the reciprocation motion of the Oldham ring is a simple harmonic motion.

In an exemplary embodiment of the invention, the scroll compressor further comprises: a coolant, provided to be fed into the compressing area through the gas-in area and then to be exhausted from the gas-out area, which can be a material selected from the group consisting of: carbon dioxide (CO2) and chlorofluorocarbon (CFC).

To sum up, as in the scroll compressor of the invention the time when the oil opening is opened is determined based upon the relative movement between the Oldham ring and the block, the scroll compressor is able to control a specific amount of lubricant to enter the oil opening in a precise manner according to the result of a mathematic calculation as well as by positioning it oil opening at a specifically designed location so that the scroll compressor is able to achieve its optimal performance. Thus, the scroll compressor can feed the lubricant into the compressing area and the gas-in area through the oil passage without the help of a regulating valve that is required in those conventional scroll compressor, by which the cost for manufacturing the scroll compressor is reduced.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 2A:
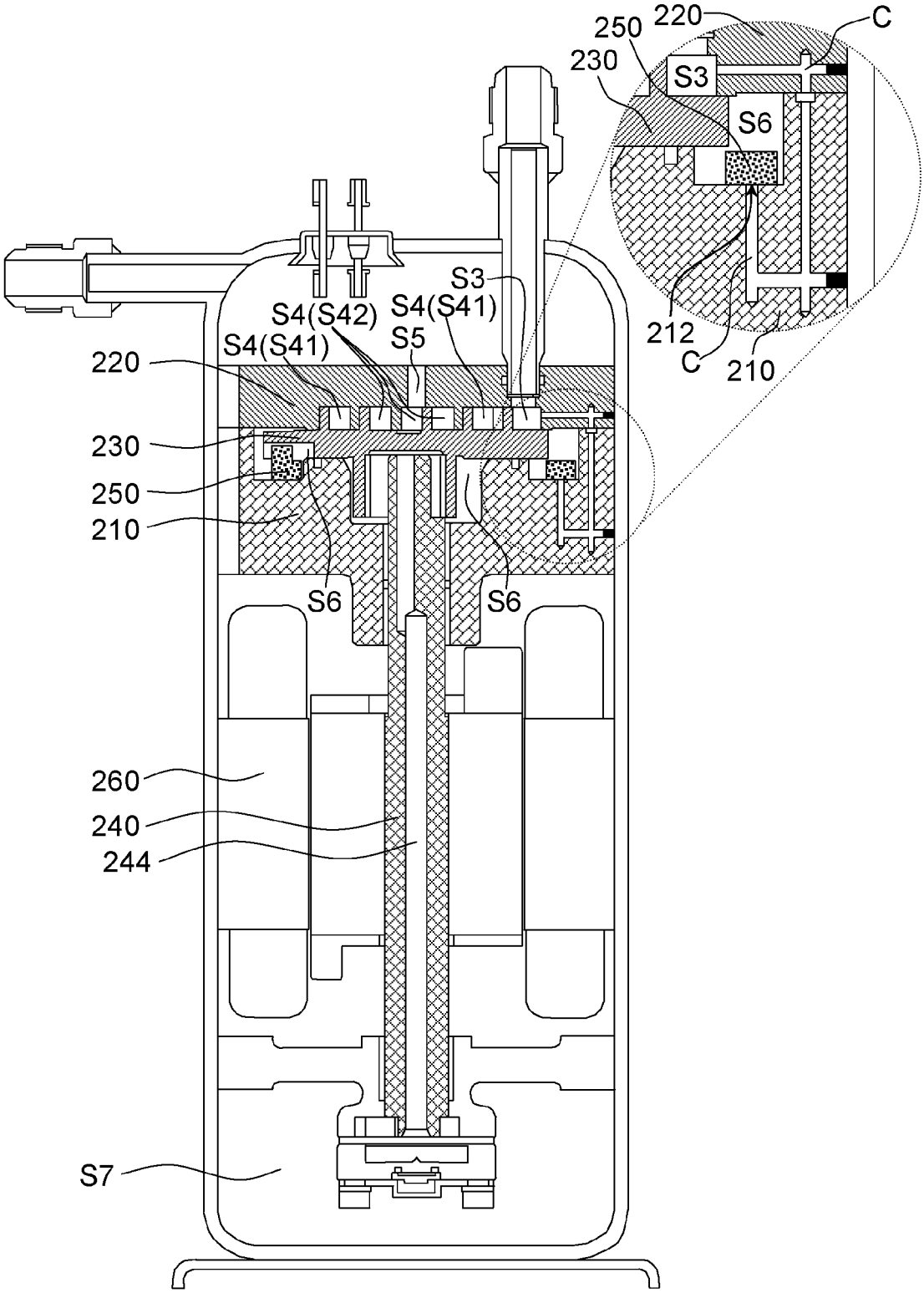
FIG. 2A and FIG. 2B are cross-sectional views of a scroll compressor according to an exemplary embodiment of the invention.
Figure 2B:
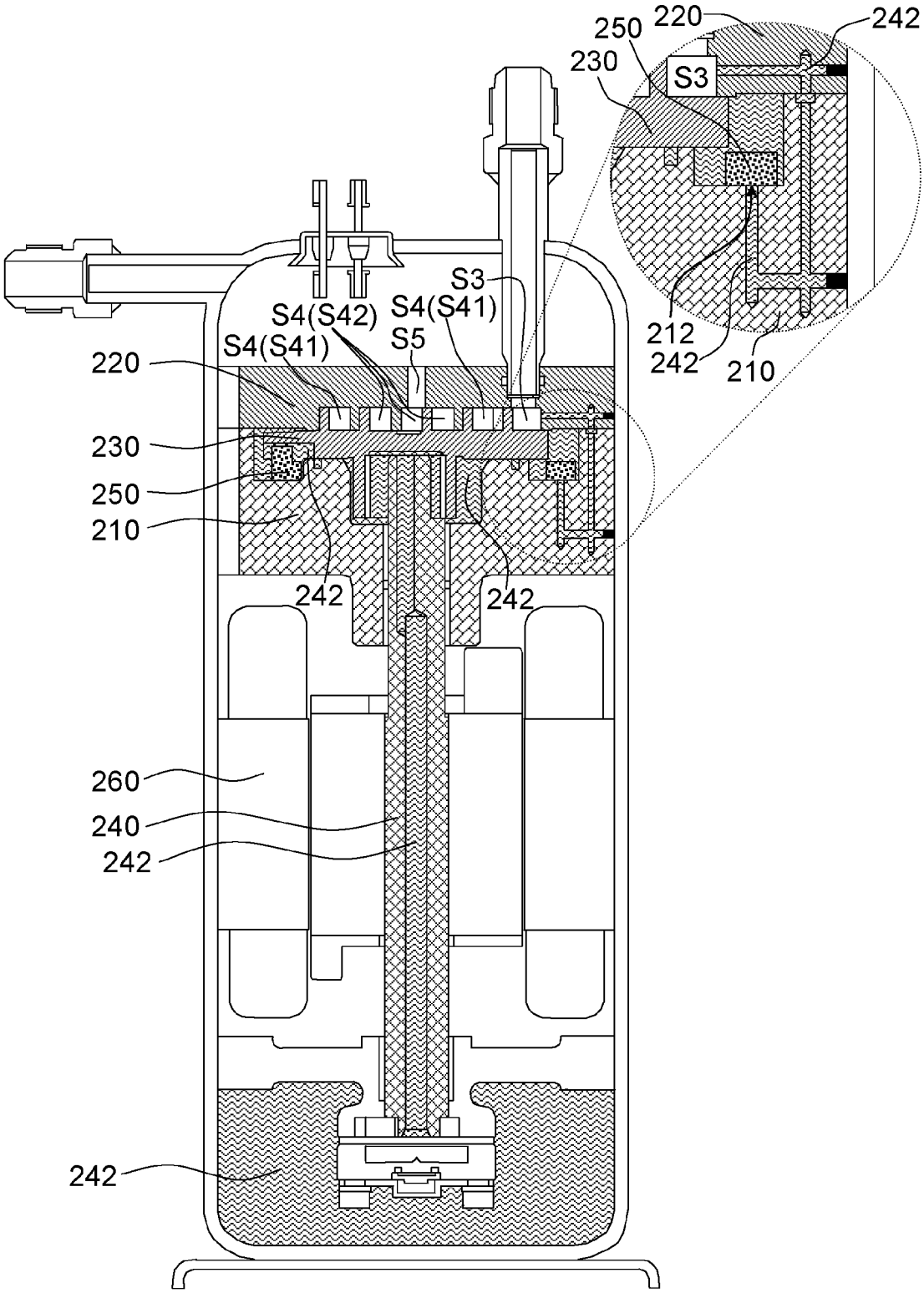

Please refer to FIG. 2A and FIG. 2B, which are respectively a cross-sectional view of a scroll compressor according to an exemplary embodiment of the invention and the lubricating oil passage of the scroll compressor of FIG. 2A. As shown in FIG. 2A and FIG. 2B, the scroll compressor of the invention comprises: a block, 210, a fixed scroll 220, an orbiting scroll 230, a crankshaft 240, an Oldham ring 250 and an oil passage C, in which the fixed scroll 220 is fixed on the block 210 while the orbiting scroll 230, the crankshaft 240 and the Oldham ring 250 are disposed on the block 210.

The orbiting scroll 230 is arranged to mesh with the fixed scroll 220 so as to form a gas-in area S3, a compressing area S4 and a gas-out area S5 which are connected in a series. Thereby, when the orbiting scroll 230 is driven to orbit around the fixed scroll 220, a coolant in the compressing area S4 will be compressed. Moreover, the coolant is fed into the compressing area S4 from the gas-in area S3 and then will be discharged from the gas-out area S5 after it is compressed.

In addition, the crankshaft 240 is connected to the orbiting scroll 230 in an eccentric manner for driving the orbiting scroll 230 to orbit around the fixed scroll 220 in a circular manner; and the Oldham ring, capable of restraining the orbiting scroll 230 from rotating, can be driven to move in correspondence to the moving of the orbiting scroll 230. Specifically, the Oldham ring 250 is driven to move reciprocatively by the moving of the orbiting scroll 230. In this exemplary embodiment, the reciprocating motion of the Oldham ring 250 is a simple harmonic motion.

From the above description, it is noted that as the reciprocating motion of the Oldham ring 250 is going to form a reciprocating motion area on the block 210, thus the scroll compressor of the invention is designed to configure an oil opening 212 in the reciprocating motion area so that the reciprocation motion of the Oldham ring 250 will cause the oil opening 212 to open and close in a periodic manner. Moreover, as the oil opening 212 is connected to the gas-in area S3 by the oil passage C, a lubricant 242 can be fed into the gas-in area S3 periodically through the oil opening 212. In this embodiment, the oil passage C is connected to the gas-in area S3, however, it can be connected to the compressing area S4 instead.

Please refer to FIG. 3A to FIG. 3D, which are schematic diagrams showing the operation of the scroll compressor of FIG. 2A. For clarity, in FIG. 3A to FIG. 3D only the relative movement between the Oldham ring and the block are depicted by the use of a solid line to define the Oldham ring and a dotted line to define the block while the absolute center of the scroll compress is identified by a reticle. FIG. 3A to FIG. 3D are diagrams showing the statuses of the scroll compressor as its orbiting scroll is orbiting about the fixed scroll at orbiting angles of 0°, 90°, 180° and 270°. In the embodiment shown in FIG. 3A~FIG. 3D with respect to FIG. 2A and FIG. 2B, the Oldham ring 250 is disposed at the upper portion of the block 210 while the oil opening 212 is formed on the top of the block 210. Moreover, the portion of the Oldham ring 250 in the neighborhood of the oil opening 212 that is the downward-bulging part of the Oldham ring 250 is marked as the shadowed area B in FIG. 3A to FIG. 3D.

Figure 3C:
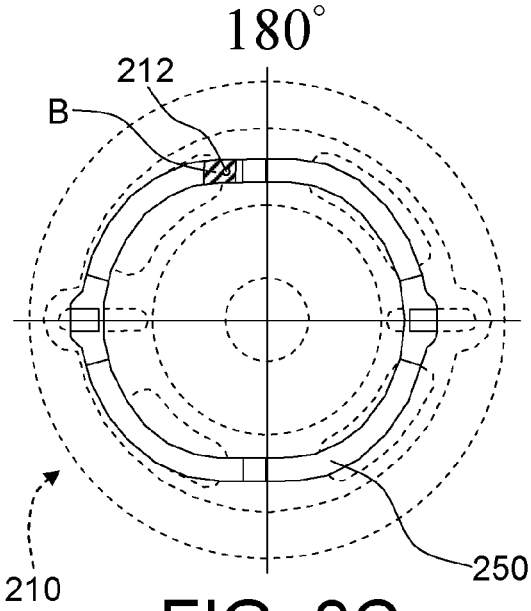
FIG. 3A~FIG. 3D are schematic diagrams showing the operation of the scroll compressor of FIG. 2A.
Figure 3B:
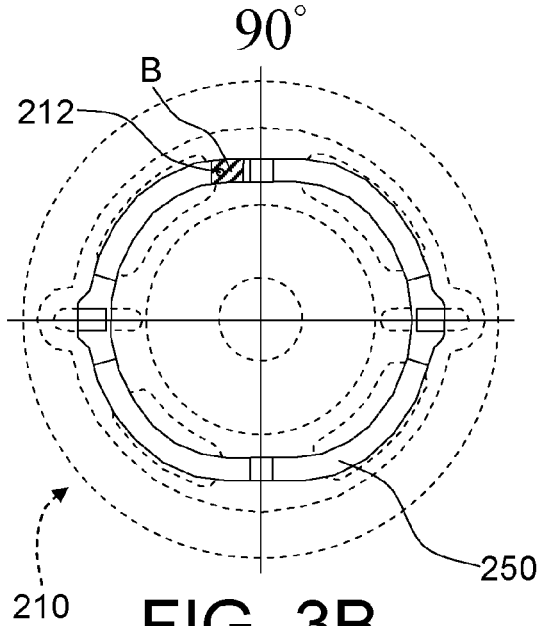
Figure 3D:
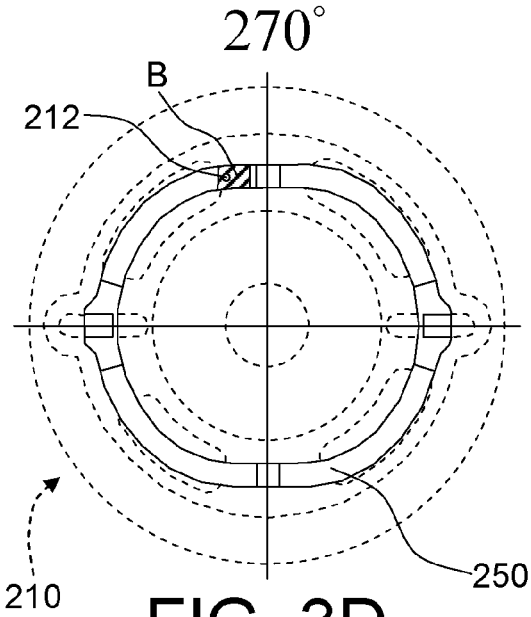
Figure 3A:
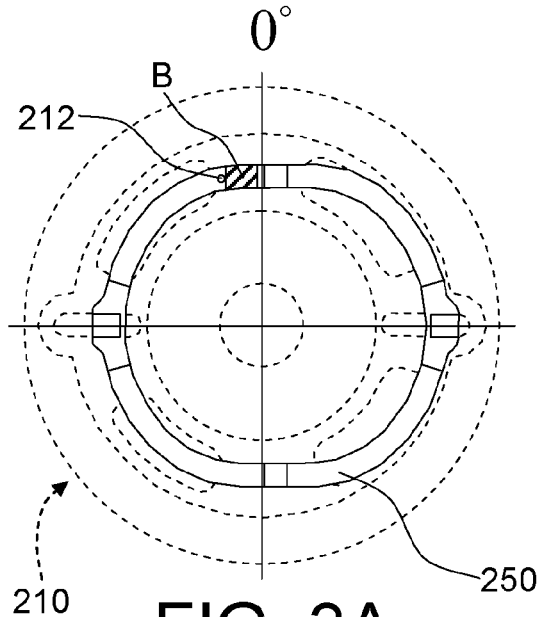

In FIG. 3A, since the shadowed area B did not cover the oil opening 212, the oil opening 212 is opened so that the lubricant 242 is able to flow from the oil opening 212 into the oil passage C. However, as the orbiting scroll 230 is being driven to orbit around the fixed scroll 220 as shown in FIG. 3B, it is going to bring the Oldham ring 250 to move toward its left and thus bring the shadowed area B to cover on the oil opening gradually, and during the process, excess lubricant 242 is prevented from entering the oil passage C. In FIG. 3C, the Oldham ring 250 is moved to its leftmost position relative to the block 210.

Up until now, the orbiting scroll 230 had complete half of its journey for orbiting around the fixed scroll 220 for one circle, and during the next half of the circle, the moving orbiting scroll 230 is going to bring the Oldham ring 250 to move toward its right. As the Oldham ring 250 is moved toward its right, it is going to reach a position as the one shown in FIG. 3D that it is moved back to the position shown in FIG. 3B. As the Oldham ring 250 is continue to move to its right by the driving of the orbiting scroll 230, the oil opening 212 will be opened gradually until the Oldham ring 250 reaches its rightmost position that is the same as the one shown in FIG. 3A.

From the above description, it is noted that the lubricant 242 can be fed into the gas-in area S3 in a periodic manner by the reciprocating motion of the Oldham ring 250 in relative to the block 210 so that the orbiting scroll 230 and the fixed scroll 220 is lubricated. In the following description, a mathematic equation used for calculating each time the amount Q of lubricant 242 being fed into the gas-in area S3 is provided, as following:

$$Q = \int V dA(r) \tag{1}$$

$$V = \left[\frac{8}{L\rho f}\frac{A(r)}{P(r)}(\Delta p)\right]^{\frac{1}{2}} \tag{2}$$

wherein V is the flowing speed of the lubricant;

A(r) is the sectional area function of the oil opening;

r is the orbiting position of the orbiting scroll relative to the fixed scroll;

L is the length of the oil passage;

ρ is the density of the lubricant;

f is the resistant coefficient;

P(r) is the perimeter function; and

Δp is the pressure difference between the two ends of the oil passage.

By substituting the equation (2) into the equation (1), the amount Q of lubricant 242 each time being fed into the gas-in area S3 is obtained. By multiplying the amount Q with a compressor operation frequency, the total amount of lubricant being fed into the gas-in area S3 per a unit of time can be calculated. Thereby, the scroll compressor of the invention is able to precisely control the amount of lubricant being fed into its compression chamber and thus its orbiting scroll as well as its fixed scroll can be lubricate properly while enabling the scroll compressor to achieve its optimal performance.

It is noted that the abovementioned equation (1) and (2) are only for illustration, the scroll compressor is not limited thereby. Those who skill in the art can modify the abovementioned two equations with reference to experiments or personal experience for obtaining what can be considered as the proper amount of lubricant. Such variations are not to be regarded as a departure from the spirit and scope of the invention.

In the exemplary embodiment shown in FIG. 2A~FIG. 2C, the oil passage C is formed at a position between the block 210 and the fixed scroll 220 that it is long enough to cause the pressure of the lubricant 242 to drop effectively. Consequently, the scroll compressor of the invention is able to feed the lubricant 242 directly from the oil passage C into its gas-in area S3 without the need of the conventional regulating valve, and thus the manufacturing cost of the scroll compressor 200 is reduced.

Figure 1A:
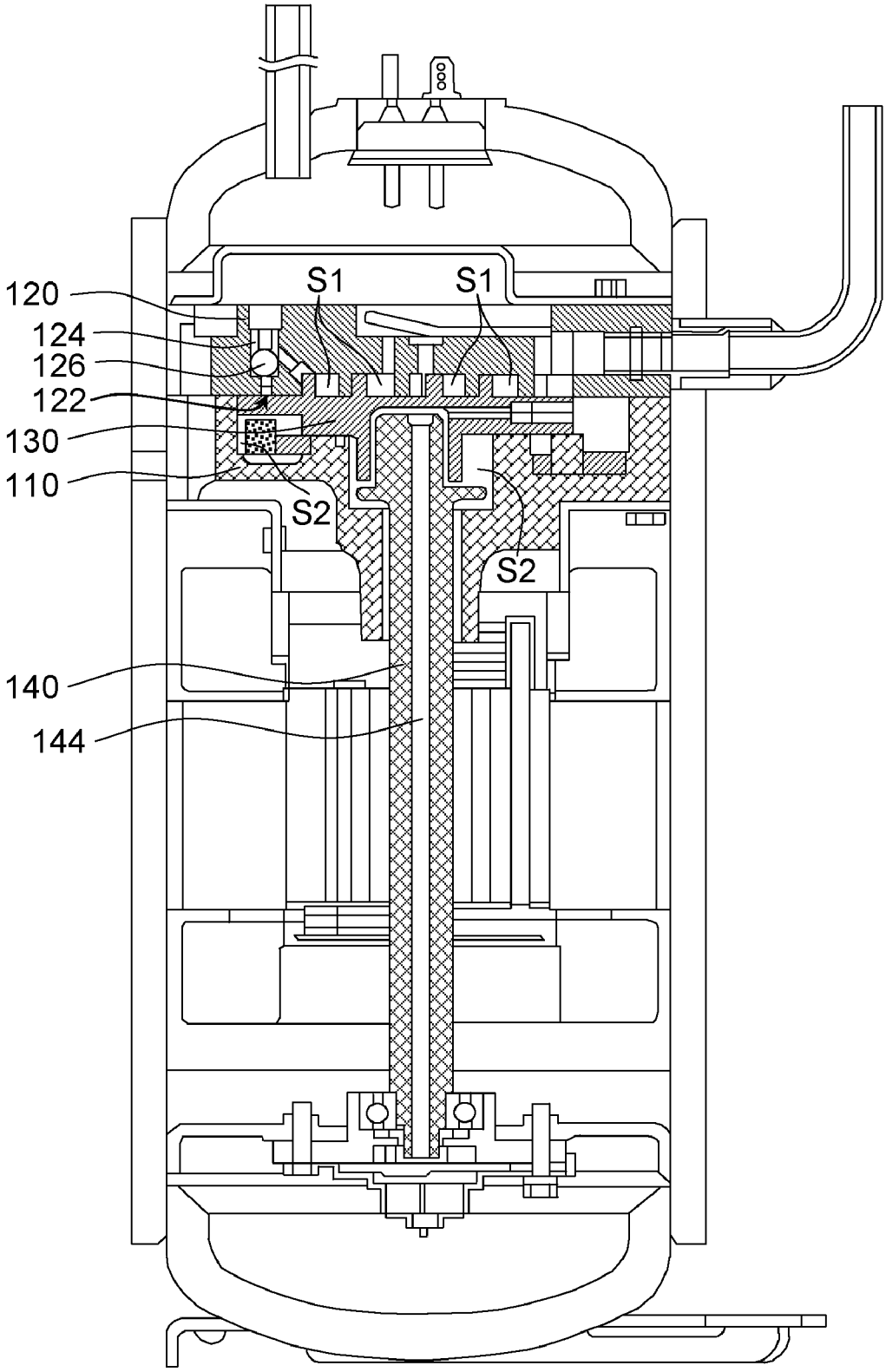
FIG.1A (Prior Art)
FIG. 1A and FIG. 1B are cross-sectional views of a conventional scroll compressor.
Figure 1B:
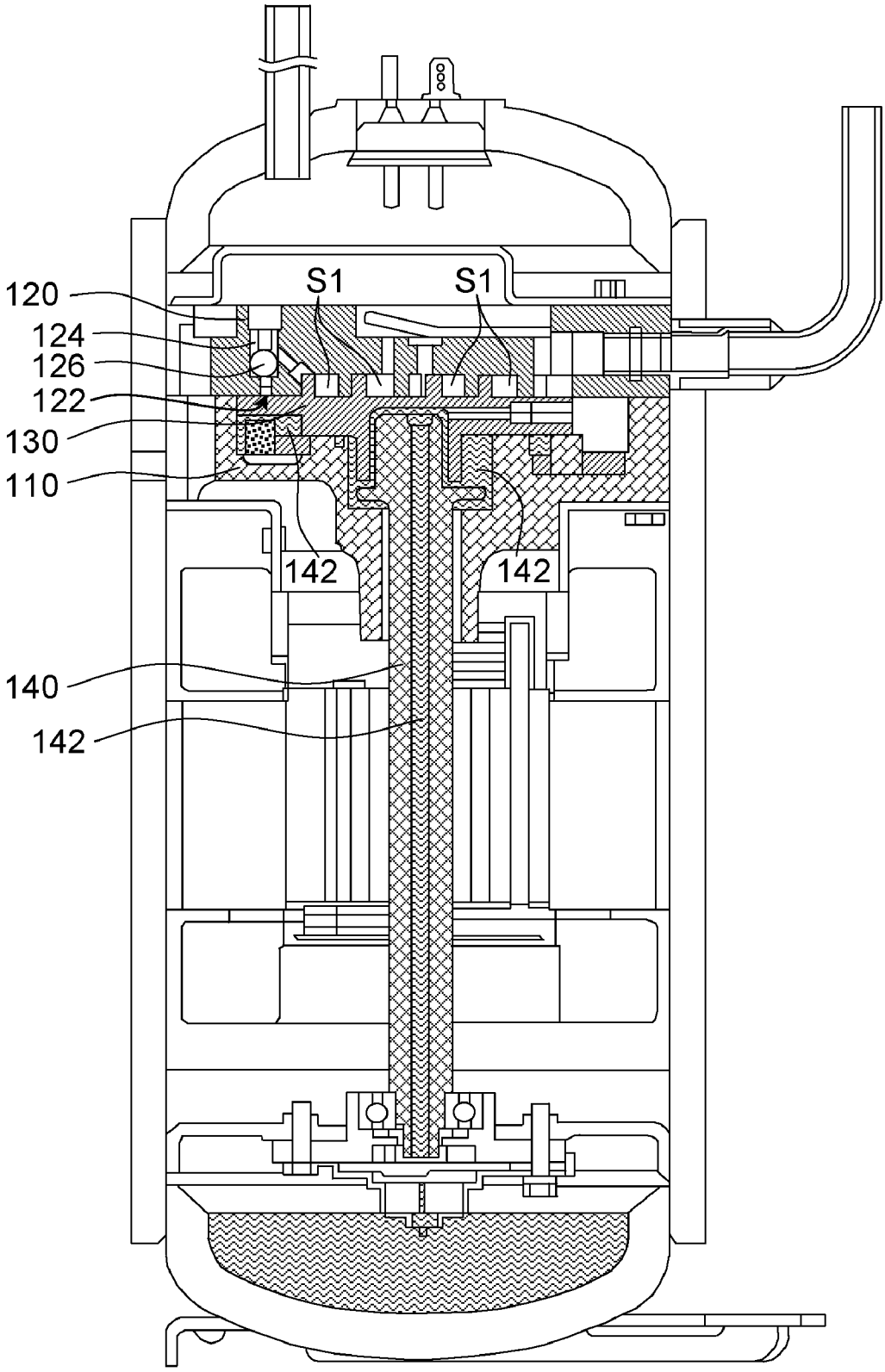
FIG.1B (Prior Art)

In addition, as the oil passage C is formed by boring a channel in the block 210 and the fixed scroll 220, the design of the scroll compressor 200 as well as its manufacturing process are simplified and thus are simpler comparing with the conventional scroll compressor 100 of FIG. 1A.

Moreover, there are a buffering area S6 formed between the orbiting scroll 230 and the block 210 for accommodating the lubricant 242, and a channel 244 formed inside the crankshaft 240 in a manner that an end of the channel 244 is connected to the buffering area S6 while enabling another end thereof to be connected to a storage S7. Thereby, the lubricant 242 stored in the storage S7 can be fed to the buffering area S6 through the channel 244, and thereafter flow into the gas-in area S3 through the oil passage C when the oil opening 212 is opened.

Although the lubricant 242 is fed into the buffering area S6 by the use of the channel 244 formed inside the crankshaft 240 as depicted in the aforesaid embodiment, the flowing path of the invention is not limited thereby. For instance, it is possible to drill a hole directly on the sidewall of the block 210 at a position corresponding to the buffering area S6 for enabling the lubricant 242 to flow directly from the hole of the block 210 into the buffering area S6.

In the aforesaid embodiment, the compressing area S4 is composed of a low-pressure zone S41 and a high-pressure zone S42, being configured in a manner that the high-pressure area S42 is connected to the gas-out area S5 and the low-pressure zone S41 is connected to the gas-in area S3. In some embodiments of the invention, the oil passage C is connected to the low-pressure zone S41. However, no matter the oil passage C is connected to the low-pressure zone S41 or is connected to the gas-in area S3 or the low-pressure zone S41, the lubricant can all be fed to its intended area for lubrication.

In this embodiment shown in FIG. 2A, the scroll compressor 200 further comprises a motor 260, which is configured for driving the crankshaft 240 to rotate. In addition, the aforesaid coolant can be carbon dioxide (CO2), chlorofluorocarbon (CFC) or other gases with similar ability.

Figure 4A:
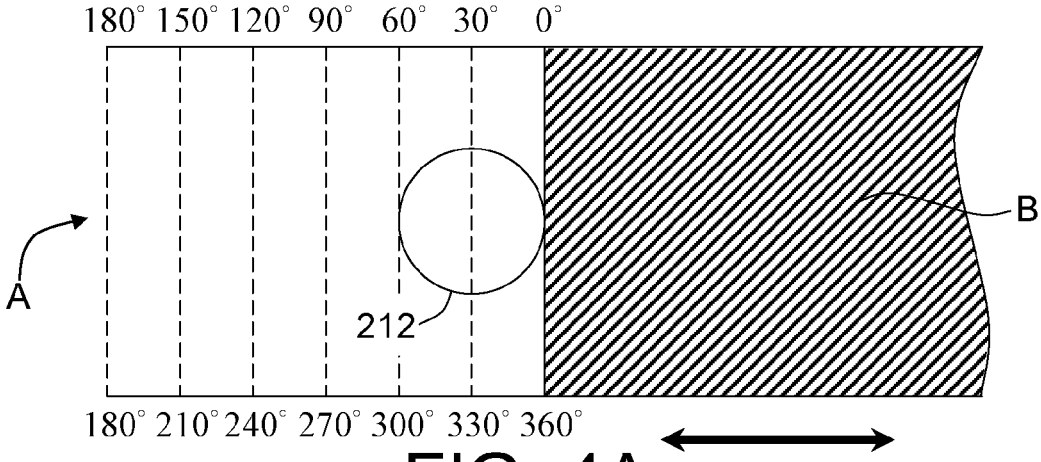
FIG. 4A is a partially enlarged view of FIG. 3A.

Please refer to FIG. 4A, which is a partially enlarged view of FIG. 3A. In FIG. 4A, the shadowed area B of the Oldham ring 250 is used to open or close the oil opening 212 as the oil opening 212 is located in the reciprocating motion area A of the Oldham ring 250, in which the oil opening 212 is opened when the orbiting scroll 230 is orbiting about the fixed scroll 220 at orbiting angles ranged between of 0° and 60°, and between of 300° and 360°. In this embodiment, the oil opening 212 is shaped as a circle and is located at the edge of the reciprocating motion area A, however, the aforesaid shape and location are only used for illustration and thus are not limited thereby.

Figure 4B:
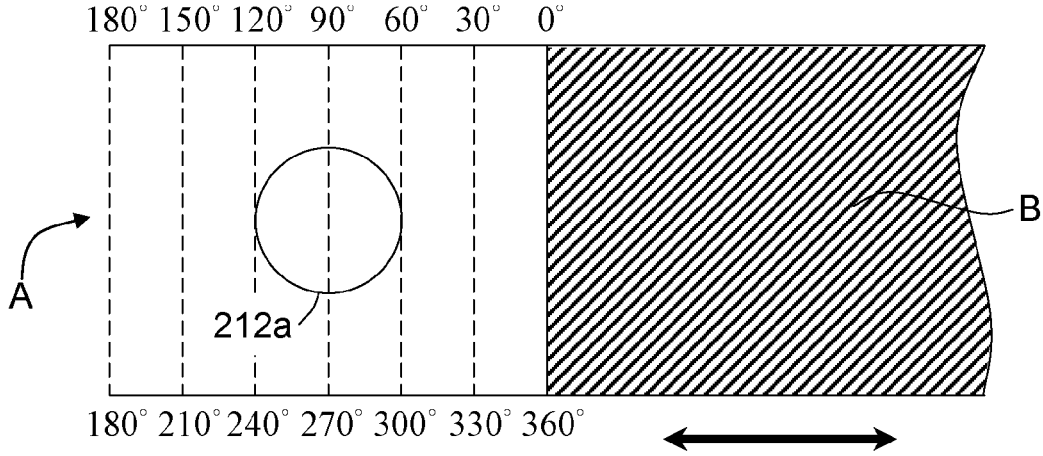
FIG. 4B and FIG. 4C are partially enlarged views of scroll compressor according to different embodiment of the invention.
Figure 4C:
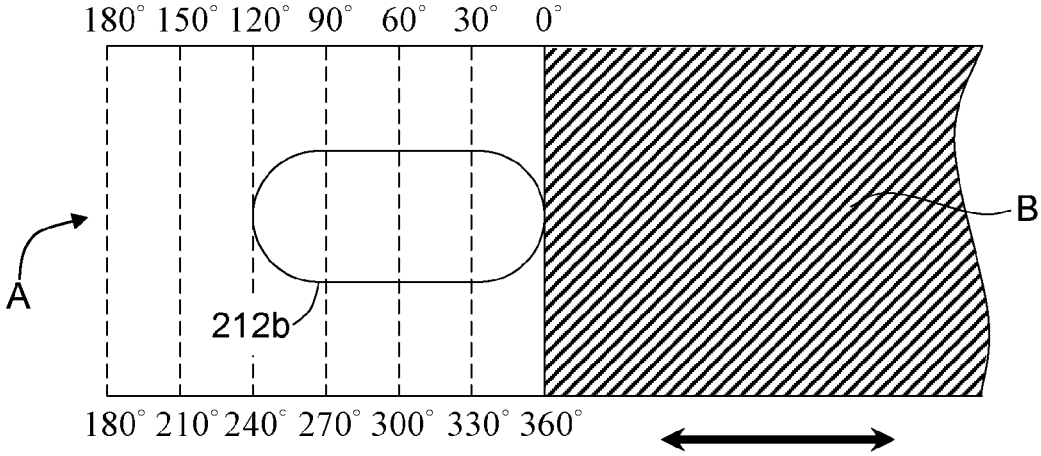

Please refer to FIG. 4B and FIG. 4C, which are partially enlarged views of scroll compressor according to different embodiment of the invention. In FIG. 4B, the oil opening 212*a* is located at the center of the reciprocating motion area A, and thus the oil opening 212*a* can be opened when the orbiting scroll 230 is orbiting about the fixed scroll 220 at orbiting angles ranged between of 0° and 120°, and between of 240° and 360°. In FIG. 4C, the oil opening 212*b* is shaped as an oval while the oil opening 212*b* is also opened when the orbiting scroll 230 is orbiting about the fixed scroll 220 at orbiting angles ranged between of 0° and 120°, and between of 240° and 360°, but the amount of lubricant traveling through the oil opening 212*b* per unit of time is larger than that of the oil opening 212*a*.

From the above description, it is noted that the amount of lubricant traveling through the oil opening is dependent upon the shape as well as the location of the oil opening. Therefore, those who skill in the art can modify the shape and location of the oil opening as required. However, such variations are not to be regarded as a departure from the spirit and scope of the invention. In addition, the oil opening in the present embodiment is formed at the top of the block, nevertheless, it can be formed on the sidewall of the block and is exemplified in the following embodiment.

Figure 5:
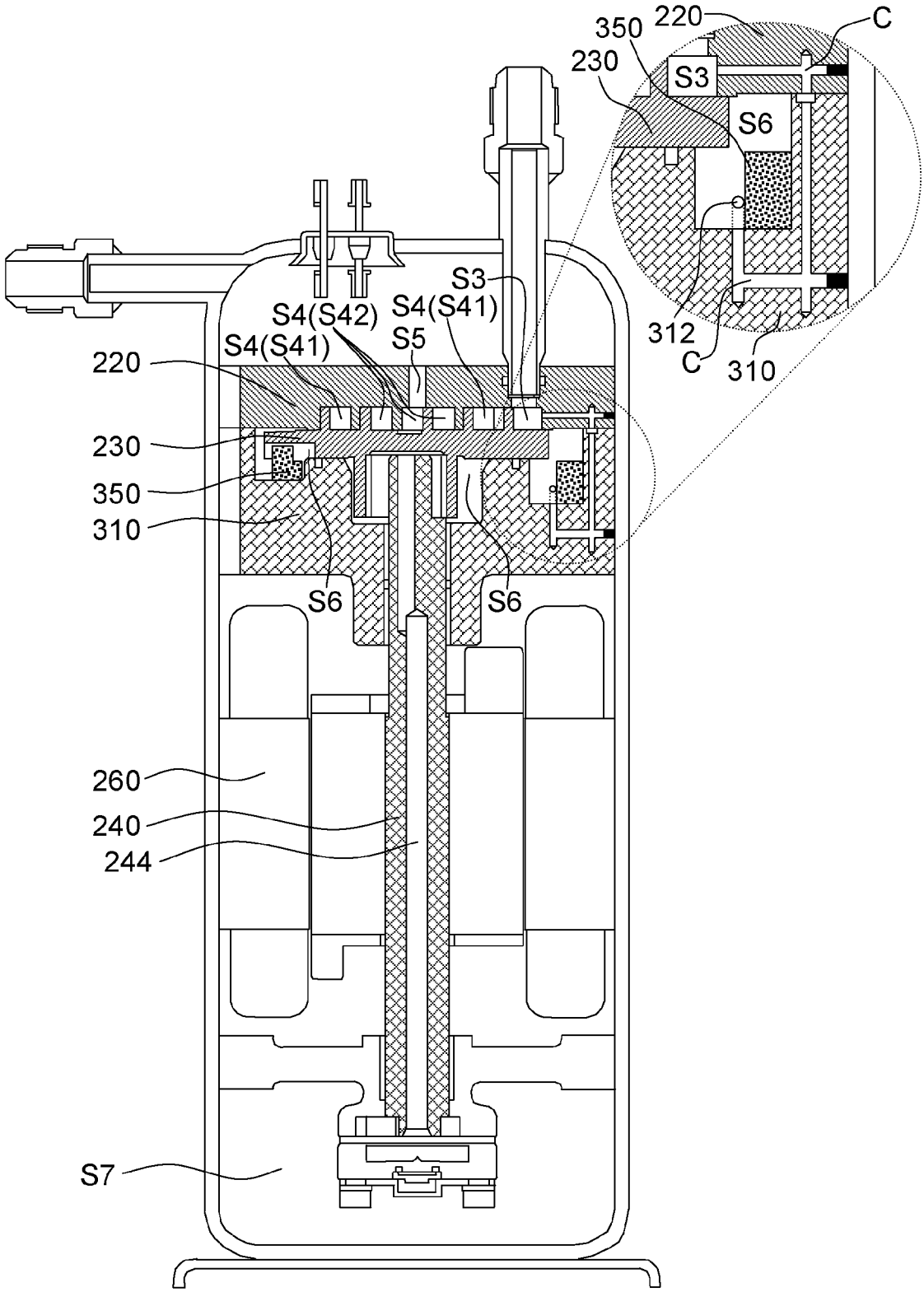
FIG. 5 is a cross-sectional view of a scroll compressor according to another exemplary embodiment of the invention.

Please refer to FIG. 5, which is a cross-sectional view of a scroll compressor according to another exemplary embodiment of the invention. The scroll compressor 300 shown in FIG. 5 is similar to the scroll compressor 200 shown in FIG. 2A, but is different in that: its oil opening 312 is formed on the sidewall of its block 310 while abutting the sidewall of its Oldham ring 350 against the sidewall of the block 310. Similarly, by the reciprocating motion of the Oldham ring 350, the oil opening 312 can be opened in a periodic manner for lubrication purpose which is the same as the foregoing description and thus is not described further herein.

By the way, although there is only one oil opening being configured in the previous-mentioned embodiments, the amount of oil opening is not limited thereby that it is dependent upon actual requirement.

To sum up, the scroll compressor is able to precisely control the timing relating to when the oil opening should be opened by the reciprocating motion of be Oldham ring about the block, and thereby, feed a proper amount of lubricant to the compressing area and the gas-in area for lubrication so as to enable the scroll compressor to achieve its optimal performance. Moreover, as its oil passage is long enough for causing the pressure of the lubricant to drop effectively, the scroll compressor can function properly without installing the conventional regulating valve and thus the lubricant can be fed directly from the oil passage into the compressing area or the gas-in area so that the manufacturing cost is reduced, in addition, as the oil passage is formed by the drilling of the block and the fixed scroll, the design as well as the manufacturing complexities are simplified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll compressor, comprising:

a block;

a fixed scroll, being fixed on the block;

an orbiting scroll, disposed on the block in a manner that the arrangement of the fixed scroll and the orbiting scroll forms a gas-in area, a compressing area and a gas-out area which are connected in a series;

a crankshaft, disposed on the block while connecting to the orbiting scroll in an eccentric manner for driving the orbiting scroll to orbit around the fixed scroll;

an Oldham ring, disposed on the block in a manner that it is enabled to perform a reciprocating motion by the driving of the moving orbiting scroll, and thus a reciprocating motion area is formed on the block; and an oil passage;

wherein, the block is further configured with an oil opening at a position thereof located in the reciprocating motion area, which is connected to a terminal of the oil passage, and the reciprocation motion of the Oldham ring will cause the oil opening to open and close in a periodic manner.

2. The scroll compressor of claim 1, wherein the oil passage is configured between the block and the fixed scroll.

3. The scroll compressor of claim 1, wherein the oil opening is shaped as a shape selected from the group consisting of: a circle and an oval.

4. The scroll compressor of claim 1, wherein the oil opening is located at a location selected from the group consisting of: the center the reciprocating motion area and the edge of the reciprocating motion area.

5. The scroll compressor of claim 1, wherein the compressing area is composed of a low-pressure zone and a high-pressure zone, mutually connected with each other while being configured in a manner that the high-pressure area is connected to the gas-out area and the low-pressure zone is connected to the gas-in area while enabling another terminal of the oil passage to be connected to the low-pressure zone.

6. The scroll compressor of claim 1, wherein a buffering area is formed between the orbiting scroll and the block to be used for accommodating a lubricant.

7. The scroll compressor of claim 6, wherein the lubricant is fed into the oil passage through the oil opening.

8. The scroll compressor of claim 7, wherein the lubricant is fed into the oil passage through the oil opening in a periodic manner.

9. The scroll compressor of claim 6, wherein a channel is formed inside the crankshaft in a manner that an end of the channel is connected to the buffering area while enabling the other end thereof to be connected to an storage.

10. The scroll compressor of claim 9, wherein the lubricant stored in the storage is fed to the buffering area through the channel.

11. The scroll compressor of claim 1, further comprising: a motor, adapted for driving the crankshaft to rotate.

12. The scroll compressor of claim 1, wherein the crankshaft is driven to bring along the orbiting scroll to orbit around the fixed scroll in a circular manner.

13. The scroll compressor of claim 1, wherein the reciprocation motion of the Oldham ring is a simple harmonic motion.

14. The scroll compressor of claim 1, further comprising:

a coolant, provided to be fed into the compressing area through the gas-in area and then to be exhausted from the gas-out area.

15. The scroll compressor of claim 14, wherein the coolant is a material selected from the group consisting of: carbon dioxide (CO2) and chlorofluorocarbon (CFC).

* * * * *